US005542633A

United States Patent [19]

Nagel

[11] Patent Number: 5,542,633

[45] Date of Patent: Aug. 6, 1996

[54] MERCHANDISE RETENTION DEVICE FOR RETROFIT INSTALLATION ON DISPLAY HOOKS

[75] Inventor: Thomas O. Nagel, Blairstown, N.J.

[73] Assignee: Trion Industries, Inc., Wilkes-Barre, Pa.

[21] Appl. No.: 511,356

[22] Filed: Aug. 4, 1995

[51] Int. Cl.[6] ..... A47B 96/06

[52] U.S. Cl. ..... 248/214; 211/57.1; 211/59.1

[58] Field of Search ..... 248/214, 309.2, 248/220.21, 551; 211/57.1, 59.1

[56] References Cited

U.S. PATENT DOCUMENTS 4,474,300 10/1984 Entis ..... 211/57.1
5,014,949 5/1991 Niven ..... 248/220.4
5,375,725 12/1994 Rosenthal ..... 211/59.1
5,423,436 6/1995 Morrow ..... 211/59.1
5,485,929 1/1996 Danon ..... 248/220.42

*Primary Examiner*—Leslie A. Braun
*Assistant Examiner*—Willie W. Berry, Jr.
*Attorney, Agent, or Firm*—Schweitzer Cornman & Gross

[57] ABSTRACT

A retention device for inhibiting removal of carded merchandise from a display hook, adapted for retrofit installation in existing loop hooks commonly used to display such merchandise. A flat plastic body, grooved along its side edges, can be inserted between and lockingly retained by the spaced apart wire elements of the U-shaped loop hook. An integral, resiliently deflectable tongue extends upward and rearward from the flat body and prevents removal of the merchandise cards unless the tongue is depressed. A flexibly hinged outer positioning member carries a locking tab, engageable with outer extremities of the loop hook, to secure the device in position after installation.

8 Claims, 2 Drawing Sheets

FIG. 1
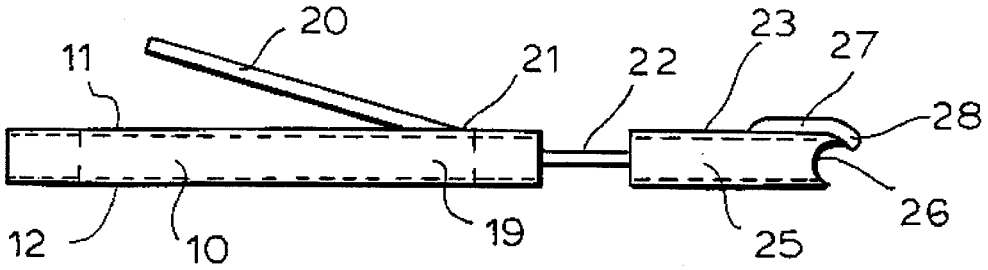
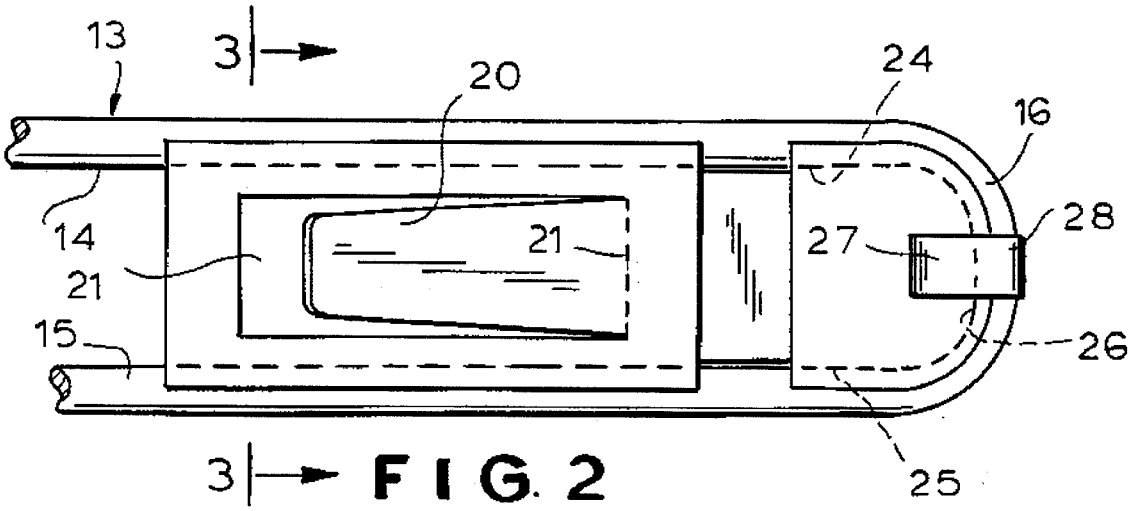
FIG. 2
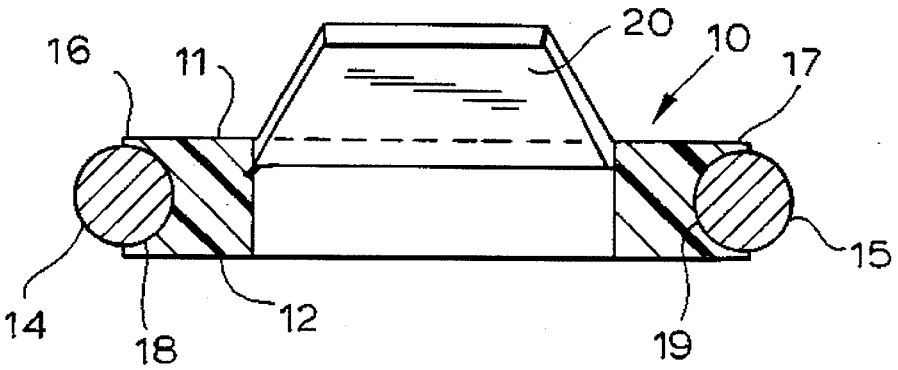
FIG. 3

FIG. 4
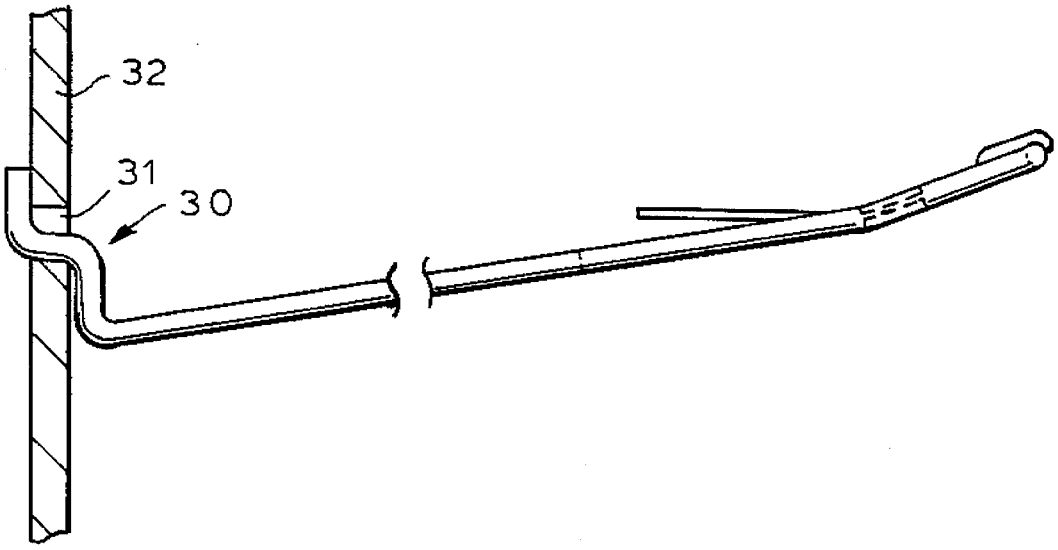
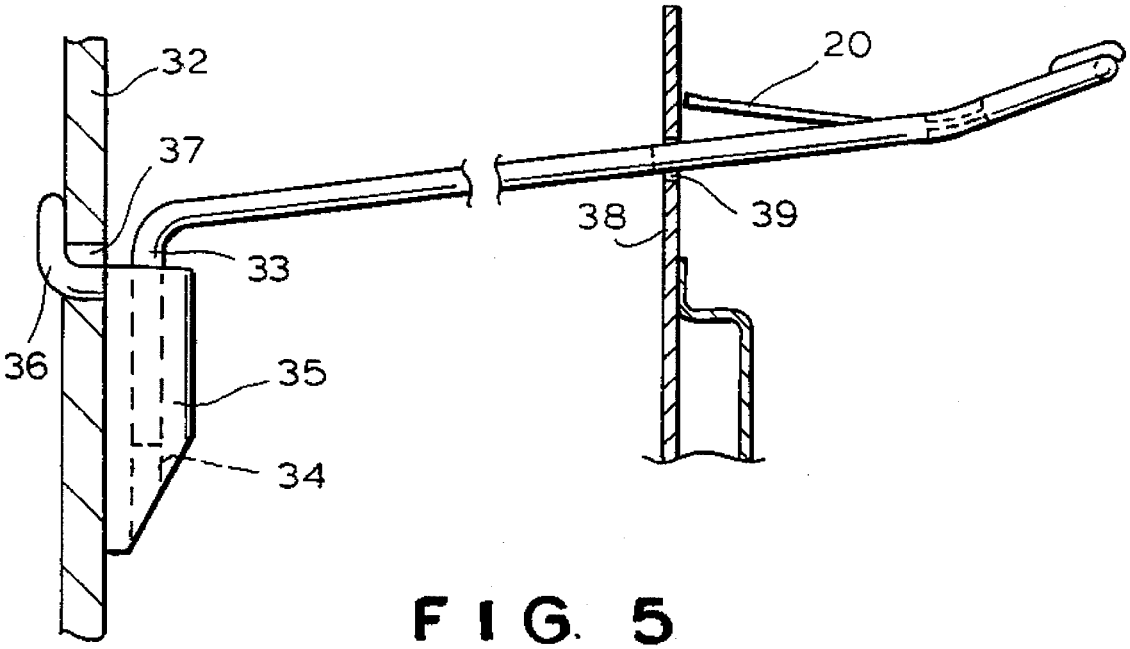
FIG. 5

MERCHANDISE RETENTION DEVICE FOR RETROFIT INSTALLATION ON DISPLAY HOOKS

BACKGROUND AND SUMMARY OF THE INVENTION

One of the widespread merchandising techniques is to suspend carded merchandise from display hooks, typically mounted on apertured panel boards. The display hooks extend outward from the panel board several inches and mount multiple sets of carded merchandise, typically all of the same kind, on the same display hook.

When the carded merchandise has significant value, pilferage can be a considerable problem, because a shoplifter can easily slide a number of objects off of a single display hook and drop them into a shopping bag or the like. This can all be done in a swift motion, and the shoplifter frequently escapes without apprehension.

A number of devices have been proposed in the past to inhibit such wholesale shoplifting. In some cases, these proposals sufficiently inhibit the removal of merchandise as to interfere with legitimate sales. In other cases, the anti-pilferage arrangements can interfere with product loading.

One of the more acceptable prior proposals for anti-pilferage of display merchandise is reflected by the Rosenthal U.S. Pat. No. 5,375,725. This patent discloses a one-piece, plastic display hook, which is formed with an upwardly and rearwardly projecting resilient tongue, near its forward end. The display hook is of generally flat, relatively rigid plastic material suitable to receive carded merchandise where the cards are formed with relatively wide, horizontal slots. The resilient tongue is arranged to deflect downwardly, when carded merchandise is loaded from front to rear onto the display hook. Once the merchandise card is behind the tongue, however, the tongue springs upwardly blocking removal of the merchandise from the display hook. Removal of the merchandise one item at a time is quite easily accomplished by depressing the resilient tongue with the thumb of one hand, while sliding the carded merchandise forwardly over the depressed tongue with the other hand. While not inhibiting legitimate, one at a time product removal, however, the device effectively prevents wholesale removal of multiple cards from the display hook in a single swooping motion.

While the device of the Rosenthal patent is functionally acceptable, it requires the complete replacement of product display hooks now existing in the marketplace, of which there are many millions. The cost of making such a complete replacement of merchandise hooks is inhibiting to many store owners and merchandise chains.

Accordingly, it is an objective of this invention to provide a anti-pilferage, merchandise retention device which is designed for retro-fit installation into existing display hook hardware. More specifically, the present invention provides a retrofit device, which may be installed in an existing "loop hook" display device, which instantly converts the otherwise conventional loop hook into an effective anti-pilferage device having a rearwardly directed resilient tongue which must be depressed in order to remove a product card from the hook.

Conventional loop hooks are formed with two outwardly extending, spaced-apart, parallel wire sections, which are joined at their outer end extremities by an integral, U-shaped wire section. Many millions of such loop hooks are currently in use throughout the world.

The device of the invention comprises a wide, flat body member, which is grooved along its opposite side edges in a manner to enable it to be snugly received between the spaced-apart, parallel wire sections of the loop hook. Once the body member is installed between the wire sections of the loop hook, it is firmly retained therein. The body member is formed with an upwardly extending, rearwardly directed resilient tongue to enable carded merchandise to pass over the body member in a rearward direction, for easy product loading onto the display hook, while effectively preventing product removal, unless the tongue is manually depressed.

In a preferred form of the invention, positioning means are provided for attachment to the outer extremity of the loop hook, in order to position the body member properly in the front-to-back direction on the hook. In a particularly preferred form of the invention, such positioning means includes a positioning member, which is separate from the body member but attached thereto by a flexible hinge. The positioning member is grooved about its front and side edges, in order to be received snugly within the U-shaped outer end portion of the loop hook. A locking element, carried on the outer end of the positioning member, grips the outer end portion of the loop hook, and secures the entire assembly in position. Because loop hooks quite typically are tilted upwardly at their outer end extremities, the flexible hinge connection between the body member of the device and the positioning member allows the latter to be disposed at an upwardly tilted angle relative to the former to accommodate contours of the hook.

The device of the invention may be economically produced as a one-piece plastic molding, so that the device may be marketed at extremely low cost.

For a more complete understanding of the above and other features and advantages of the invention, reference should be made to the following detailed description of a preferred embodiment of the invention and to the accompanying drawings.

DESCRIPTION OF THE DRAWINGS

FIG. 1 is a side elevational view of a merchandise retention device according to the invention.

FIG. 2 is a top plan view of the device of FIG. 1.

FIG. 3 is an enlarged cross sectional view as taken generally on line 3—3 of FIG. 2.

FIG. 4 is a side elevational view illustrating one form of conventional loop hook incorporating the device of the invention.

FIG. 5 is a view, similar to FIG. 4, showing a second form of loop hook incorporating the device of the invention and illustrating carded merchandise supported thereon.

DESCRIPTION OF PREFERRED EMBODIMENTS

Referring now to the drawing, the reference numeral 10 designates generally a body member of the new device, which is formed of plastic material and has generally flat, rectangular configuration. The thickness of the body 10, between its upper and lower surfaces 11, 12, is approximately equal to the diameter of the wire employed in the loop hook display device. Such a device is shown in a fragmentary way at 13 in FIG. 2, where the hook is shown to include first and second spaced-apart parallel wire elements 14, 15 integrally joined at their outer end by a U-shaped end portion 16.

The width of the body member 10, as reflected in FIG. 2, is approximately equal to the center-line-to-center-line distance between the wire side elements 14, 15 of the loop hook 13.

As shown in FIG. 3, the opposite side edges 16, 17 of the body member 10 are formed with semi-cylindrical grooves 18, 19, which are arranged to snugly receive the spaced-apart side elements 14, 15 of the loop hook. Thus, when the body member 10 is installed in position between the wire elements 14, 15, the body member is firmly retained in position therebetween and in general retains the wide, flat configuration of the loop hook, so as not to interfere with the passage of carded merchandise thereover.

In the device of the invention, the body member 10 is provided with an integral, upwardly projecting and rearwardly extending resilient tongue 20, which is anchored at its outer end 21. In the area of the resilient tongue 20, the body member is provided with a through opening 21, or a suitable recess, permitting the resilient tongue 20 to be depressed substantially into the cross sectional configuration of the body 10 itself.

At the forward end of the body member 10 is an integral, flexible hinge element 22, which joins with a positioning member 23. The positioning member is molded integrally with the body 10 and hinge 22, and has width and thickness dimensions generally corresponding to those of the body member 10. As shown in FIGS. 1 and 2, the positioning member 23 is provided with lateral grooves 24, 25 on its side edges, and a U-shaped groove 26 extending around its forward edge, allowing the positioning member to be seated in and retained in position by the U-shaped outer portion 16 of the loop hook.

While the friction between the side edges of the body member 10 and positioning member 23 may be adequate in many cases to retain the device properly positioned in the loop hook, it is preferred to provide a locking tab 27, which is integral with the positioning member 23 and extends forwardly from center portions thereof. The locking tab is provided with an outwardly and downwardly extending portion 28 which is arranged to be resiliently upwardly displaced as the positioning member is pressed forwardly into a fully seated position against outer portions 16 of the loop hook. When the positioning member 23 is fully seated, the outermost portion 28 of the locking tab resiliently grips forward portions of the loop hook and secures the entire device in the desired position in the loop hook.

As shown in FIGS. 4 and 5, the outer extremities of wire loop hooks quite commonly are tilted upwardly with respect to the main body of the hook. Accordingly, the dimensions of the positioning member 23, in the front-to-back direction of the loop hook, are relatively small in relation to the overall length of the device. Accordingly, when the device is installed in position between the space-apart wires of the loop hook and pushed outwardly toward the outer end, the positioning member 23 can follow the bend at the outer end of the hook and assume the angle of the outer end portion. The flexible hinge member 22 accommodates the existence of this angular relationship after installation, as will be understood.

Common forms of loop hooks are shown in FIGS. 4 and 5. In the FIG. 4 version, the inner ends of the wire elements are configured as shown at 30, to provide L-shaped mounting lugs arranged to be inserted into a pair of adjacent openings 31 in a apertured panel board 32. In another widely used form of loop hook, shown in FIG. 5, the inner ends of the individual wire elements of the loop hooks are bent vertically downward, as shown at 33, and are inserted into vertical openings 34 in a molded plastic base member 35. The base member is formed with integral plastic L-shaped lugs 36 which are received in openings 37 in the panel board 32.

Where the loop hooks are sufficiently long, it may be possible to resiliently separate mid portions of the wire elements to accommodate installation of the merchandise retention device, without removal of the hook from the apertured panel board. Where this is not possible, or not convenient, the hook may be removed from the panel board, which allows the side elements to be easily separated as necessary for installation of the retention device.

As shown in FIG. 5, an item 38 of carded merchandise is typically provided with a wide flat opening 39 of a size and shape to be easily received over the outer end of a conventional wire loop hook. Such a conventional card is easily applied over loop hooks in which merchandise retention devices have been installed because, except for the locking tab 27 at the outer end and the resilient tongue 20, the device of the invention does not significantly alter the cross sectional configuration of the wire loop hook. The locking tab 27 itself is easily accommodated within the conventional opening 39 in the merchandise card. However, the tongue 20 must be depressed in order to accomplish loading and removal of the merchandise. Loading of the merchandise can be easily accomplished by simply sliding the card rearwardly and allowing the card itself to depress the tongue as necessary. Removal, of course, requires manual depression of the tongue, as previously described.

The device of the invention, while incorporating some of the beneficial functional features of the Rosenthal U.S. Pat. No. 5,375,725, has significant practical advantages for certain purposes because it enables retrofit installation of a merchandise retention device in the enormous numbers of existing loop hooks that are already installed throughout the world. The invention can be inexpensively manufactured with high production, injection molding techniques, using conventional structural plastic materials. Installation can be easily accomplished by unskilled store personnel, and the invention thus provides an advantageous, low cost alternative to complete replacement of existing hardware.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A merchandise retention device adapted for retrofit mounting on a wire loop hook, where the loop hook comprises elongated, spaced-apart, parallel side elements formed of wire and integrally joined at forward ends thereof by a generally U-shaped outer wire portion, which comprises (a) a generally flat body member having a length less than the length of the wire side elements of the loop hook, (b) said body member having spaced-apart side edges formed over at least a portion thereof with opposed, outwardly facing grooves, (c) said body member having a width such that, when said body member is positioned between spaced-apart side elements of a loop hook, said side elements are partially received in said opposed grooves, whereby said body member is adapted to be lockingly held in said loop hook, (d) a merchandise retention tongue having one end anchored in said body member and projecting upwardly and rearwardly therefrom to a position for blocking the movement of carded merchandise, supported on said loop hook rearwardly of said tongue, past said tongue in a forward direction, (e) said tongue being resiliently depressably toward said body member to enable carded merchandise to be placed on said loop hook and to be controllably removed therefrom.

2. A merchandise retention device according to claim 1, wherein (a) said body member has a thickness adapted to not substantially exceed diametral dimensions of said wire side elements.

3. A merchandise retention device according to claim 1, wherein (a) said body member and said retention tongue are integrally molded of plastic material, (b) said body member is formed with a recess therein underlying said retention tongue and into which said tongue may be depressed to accommodate the passage of carded merchandise over said retention device.

4. A merchandise retention device according to claim 1, wherein (a) positioning means are provided for locking said body member against sliding movement along said wire side elements.

5. A merchandise retention device according to claim 4, wherein said positioning means comprises (a) a positioning member flexibly joined with said body member at a forward end thereof, and (b) a locking tab projecting from a forward edge of said positioning member and lockingly engageable with a forwardmost portion of said loop hook.

6. A merchandise retention device according to claim 5, wherein (a) said positioning member comprises a generally flat member grooved on side and front edges thereof for confining engagement with U-shaped outer portions of said loop hook.

7. A merchandise retention device according to claim 6, wherein (a) said body member and said positioning member are joined by a flexible hinge element, whereby said positioning means can be held in confining engagement with a U-shaped outer portion disposed at an angle to wire side elements of a loop hook.

8. A merchandise retention device according to claim 7, wherein (a) said body member, flexible hinge element and said positioning member are integrally formed of molded plastic material.

* * * * *